US006102768A

United States Patent [19]

Cho

[11] Patent Number: 6,102,768

[45] Date of Patent: Aug. 15, 2000

[54] SEGMENTED OBJECT FOR USE AS AN ADVERTISING ITEM, PROMOTIONAL ITEM, TOY, OR DECORATIVE FIGURE

[76] Inventor: Daniel H. Cho, 1625 Buckthorn Dr., Hoffman Estates, Ill. 60195

[21] Appl. No.: 09/358,974

[22] Filed: Jul. 22, 1999

Related U.S. Application Data

[63] Continuation-in-part of application No. 09/314,263, May 18, 1999.

[51] Int. Cl.[7] ..... A63H 29/10

[52] U.S. Cl. ..... 446/177; 446/268; 446/901; 428/31

[58] Field of Search ..... 428/31; 446/69, 446/71, 72, 73, 77, 79, 80, 92, 97, 101, 208, 371, 376, 382, 901

[56] References Cited

U.S. PATENT DOCUMENTS

| | | | |
|---|---|---|---|
| D. 161,098 | 12/1950 | Gelardin . | |
| D. 276,451 | 11/1984 | Panicci . | |
| D. 285,321 | 8/1986 | Thomson . | |
| 1,710,989 | 4/1929 | Kelly . | |
| 2,254,810 | 9/1941 | Will | 446/446 |
| 4,235,041 | 11/1980 | Sweet . | |
| 4,794,025 | 12/1988 | Yamanaka | 428/31 |
| 5,102,365 | 4/1992 | Huang et al. | 446/376 |
| 5,288,257 | 2/1994 | Zacherl | 446/72 |
| 5,396,408 | 3/1995 | Szczech . | |
| 5,746,637 | 5/1998 | Hunt | 446/72 |

*Primary Examiner*—Sam Rimell

*Attorney, Agent, or Firm*—Charles F. Meroni, Jr.; Meroni & Meroni

[57] ABSTRACT

An object, which can be used as an advertising item, promotional item, toy, or decorative figure, is segmented into at least two portions which are mounted in an aligned fashion on opposing sides of a surface so that the object appears to be extending through the surface. The object is provided in the shape of a commercial product to be advertised, or in the shape of a creature, such as animal or insect, or in the shape of holiday character, such as Santa Clause or a Halloween bat. The object is attached to the surface using suction cups which are mounted within the hollow interior of the object, so that when the object is mounted to the surface in an aligned fashion, the suction cups are not seen by viewer. The individual portions of the segmented object can be also be attached directly to each other to form a complete toy which can be played with in a traditional manner.

44 Claims, 7 Drawing Sheets

SEGMENTED OBJECT FOR USE AS AN ADVERTISING ITEM, PROMOTIONAL ITEM, TOY, OR DECORATIVE FIGURE

PRIOR HISTORY

This application is a continuation in part of a previous application by the same inventor titled SEGMENTED OBJECT FOR USE AS A TOY OR DECORATIVE FIGURE and having case ser. No. 09/314,236, filed May 18, 1999.

FIELD OF THE INVENTION

The present invention relates to a segmented object which can be used as a commercial advertising item, promotional item, toy, or decorative figure. Specifically, an object having the appearance of a commercial advertising item or promotional item such as a beverage container or piece of sports equipment, or having the appearance of a creature such as a animal, insect, dinosaur or holiday character is provided in two pieces which are mounted adjacent each other on opposing sides of a structure so that the object appears to be extending through the structure.

BACKGROUND OF THE INVENTION

Surface mountable decorative figures and toys are well known in the prior art. D161,098, D276,451, D285,321 are examples of design patents directed to toys which are attached to table tops using suction cups mounted to the underside of the exterior of the toy. U.S. Pat. No. 1,710,989, 4,235,041, and 5,396,408 are directed to toys or decorative figures which are mounted to one side of a surface using suction cups attached to the exterior of the object. U.S. Pat. No. 5,288,257 by Zacherl is directed to a door stop in the shape of toy figure which is draped over the top edge of a door and then secured to the door using suction cups. Although this figure is mounted such that it lies on both sides of the door, the figure is not segmented, and the suction cups are mounted to the exterior surface of the figure.

SUMMARY OF THE INVENTION

A segmented object which is mounted to opposing sides of a surface so that it appears to be extending through the surface is not found in the prior art. This a novel and fresh approach to commercial advertising items, promotional items, toys, and decorative figures which is visually gripping. Such an object could be used in many ways. As a commercial advertising and/or promotional item, the segmented object could be used in store windows and displays, at restaurants and bars, and at sporting events. As a decorative item, the segmented object could be used in the home, car, workplace, or store. As a toy, the segmented object is attractive to both adults and children because of its novelty and versatility. It is provided in a variety of external shapes to accommodate a wide variety of possible personal tastes and requirements.

The present invention is an object which can be used as a commercial advertising item, promotional item, toy, or decorative figure. The object is segmented into at least two portions which are mounted in an aligned fashion on opposing sides of a surface so that the object appears to be extending through the surface. The object is provided in the shape of an advertising or promotional item such as a beverage container or piece of sporting equipment, in the shape of a creature, such as animal or insect, or in the shape of holiday character, such as Santa Clause or a Halloween bat. The object is attached to the surface using suction cups, magnets, or other means which are mounted within the interior of the object, so that when the object is mounted to the surface in an aligned fashion, the attachment means is not seen by viewer.

The segmented object can be easily removed or repositioned as required by the user.

The individual portions of the segmented object can be attached directly to each other to form a complete figure which can be played with in a traditional manner or used as a traditional free standing advertising or promotional item.

DETAILED DESCRIPTION

Figure 1:
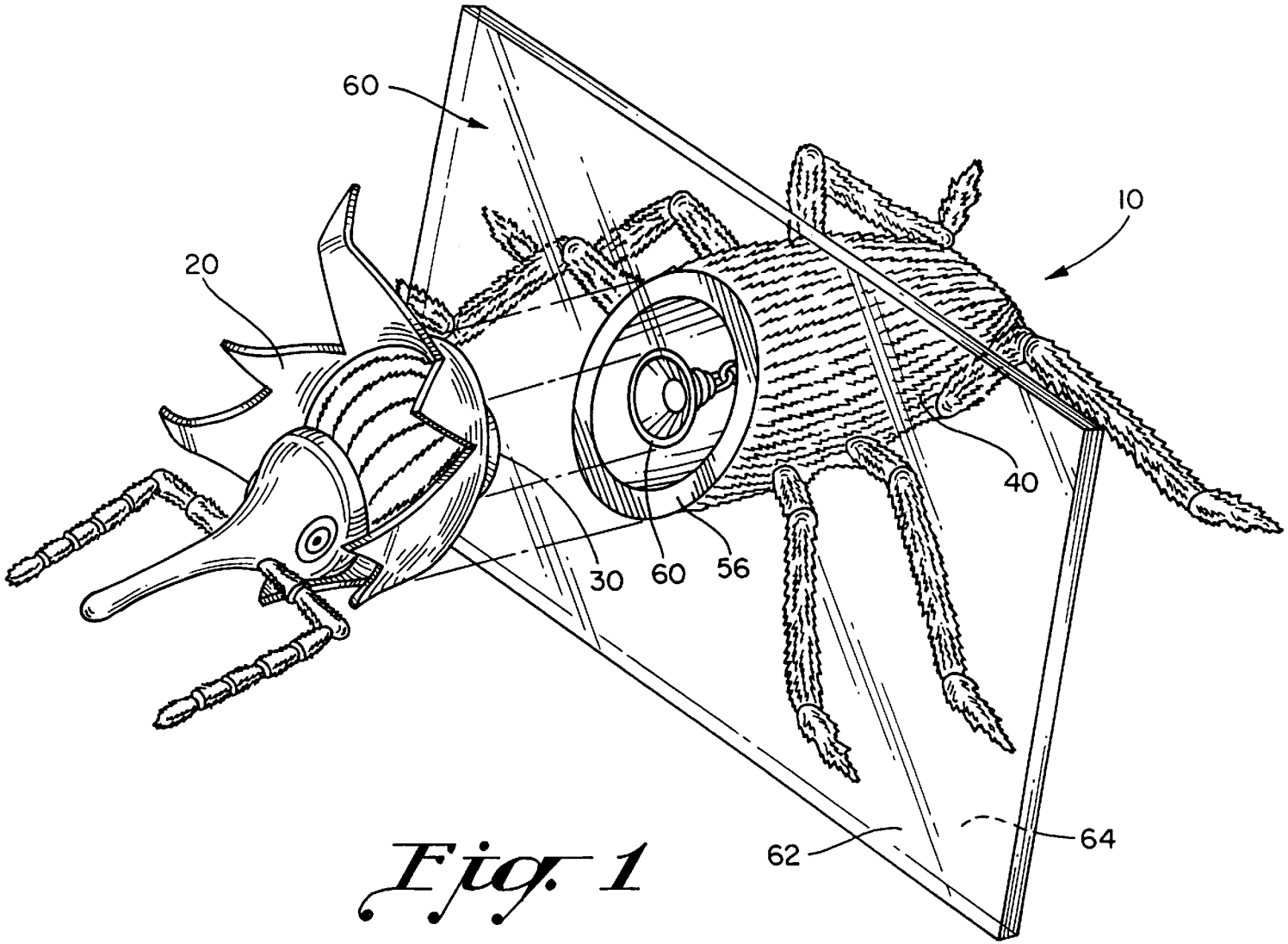
FIG. 1 is a partially exploded perspective view of the object in the form of an insect, the insect being attached to a pane of glass using suction cups so that the first portion and second portion of the insect are aligned but mounted on opposing sides of the pane of glass, giving the appearance of an insect passing through the pane of glass.

Referring now to the drawings, the inventive segmented object for use as an advertising item, promotional item, toy, or decoration will now be described in full detail. The segmented object 10 will be provided in a wide variety of external shapes, the external shape being dependent upon the intended use of the segmented object.

Figure 9:
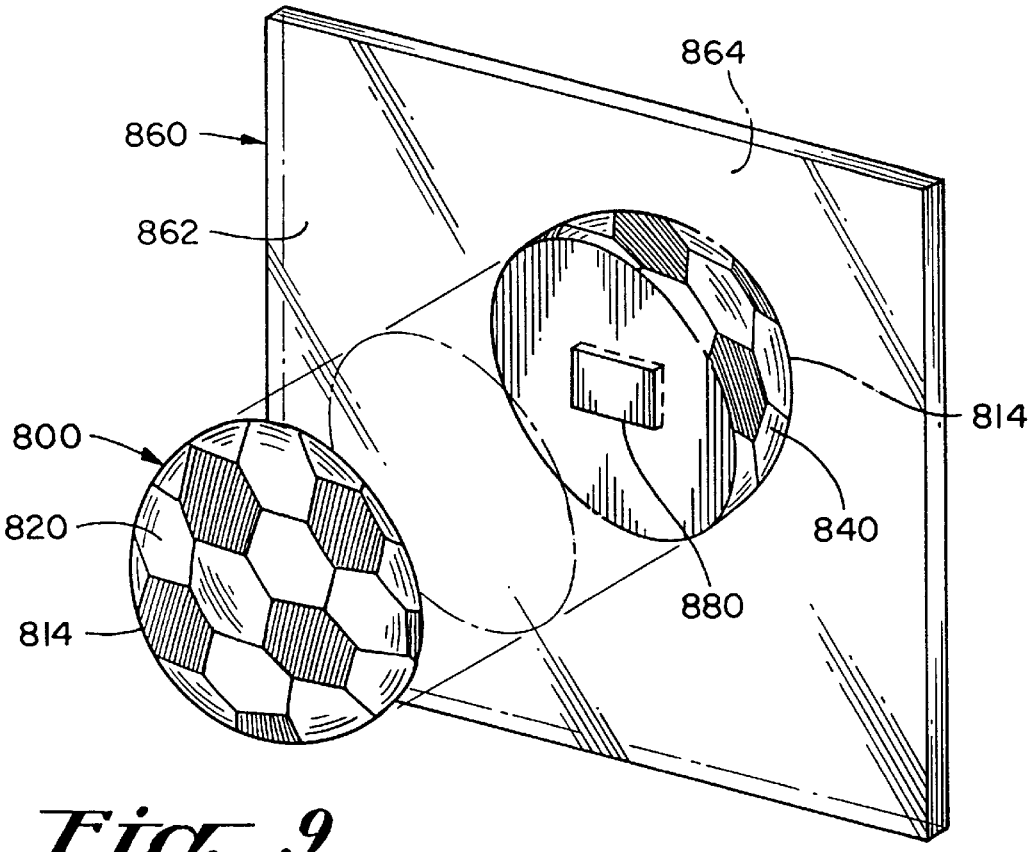
FIG. 9 is a partially exploded perspective view of the object in the form of a soccer ball, the soccer ball having a solid cross section and being attached to a pane of glass using magnets which are mounted in a concavity formed in the sectioned surface. The result is that the first portion and second portion of the soccer ball are aligned but mounted on opposing sides of the pane of glass, giving the appearance of a soccer ball passing through the pane of glass.
Figure 11:
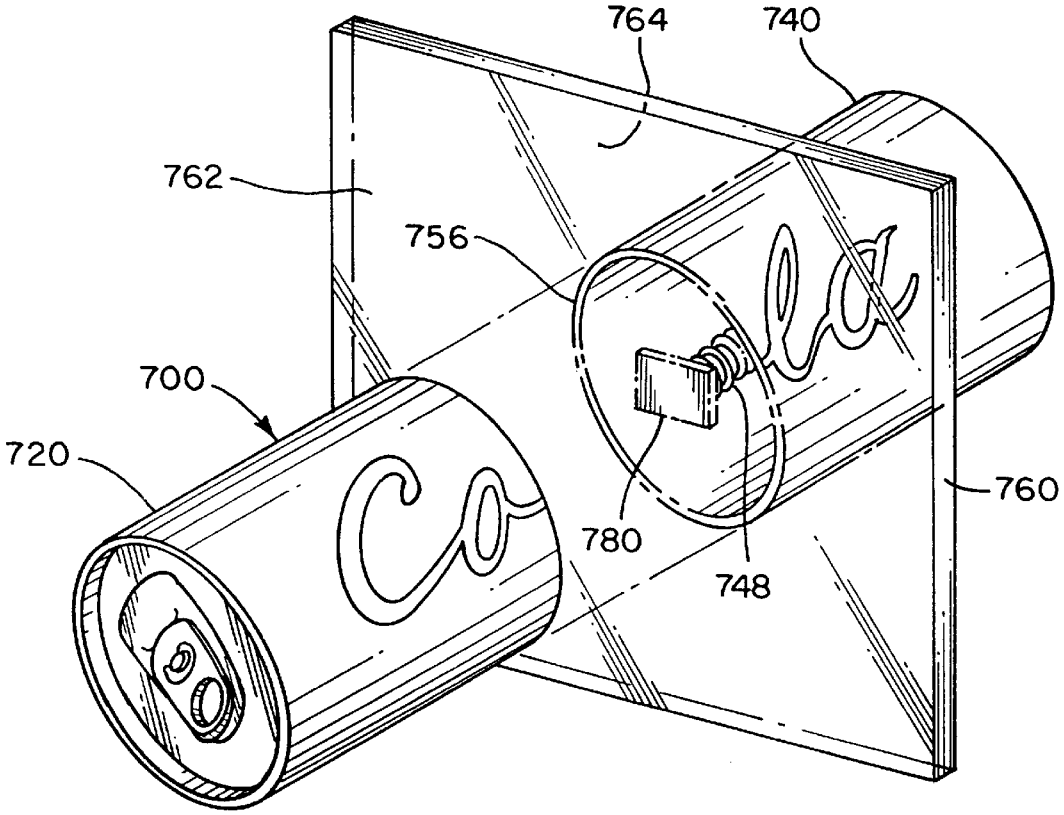
FIG. 11 is a partially exploded perspective view of a hollow segmented object in the form of a beverage container attached to a pane of glass using magnets so that the first portion and second portion of the soccer ball are aligned but mounted on opposing sides of the pane of glass, giving the appearance of a beverage container passing through the pane of glass, illustrating the segmented object's use as a commercial advertising or promotional item.

When used as a commercial advertising or promotional item, segmented object 10 can have the external shape of an item being promoted, or of a commercial figure or object which is associated with a product, a brand name, or with a company. The external shapes the item or figure may take include, but are not limited to hamburgers or drink cups for the food industry; shoes, balls, bats, stick, or racquets for the sports industry; cars or wheels for the automotive industry; beverage containers for the beverage industry; tractors, barns, farm animals, or produce for the agricultural industry. For example, FIG. 11 illustrates a segmented object as a beverage container 700 being used to advertise or promote a specific brand of soft drink or beer. As a second example, FIG. 9 illustrates a soccer ball 800 being used to promote a sport item, a piece of sports equipment, or a sporting event.

When used as a toy or decoration, segmented object 10 can have the external shape of a creature. The creature may be real or imaginary, and includes but is not limited to animals, insects, dinosaurs, cartoon characters, and holiday characters. Animal characters include, but are not limited to, human beings; fish; pets; and wild animals.

Holiday characters include, but are not limited to, bats, spiders, and witches for Halloween; reindeer, elves, and Santa Clause for Christmas; rabbits and chicks for Easter; leprechauns for St. Patrick's Day; Uncle Sam for the Fourth of July; Lincoln and Washington for President's Day; turkeys for Thanksgiving.

Segmented object 10 is generally formed as a whole, complete object and then sectioned to form at least two portions. In the preferred embodiment, segmented object 10 is sectioned to form two portions, a first portion 20 and a second portion 40. Segmented object 10 is mounted to a surface 60 by placing the first portion 20 on a first side 62 of the surface 60 and by placing the second portion 40 on the second side 64 of the surface 60 such that the first portion 20 lies adjacent to and aligned with the second portion 40 so that the segmented object 10 appears to be extending through surface 60 in an uninterrupted, continuous fashion.

Surface 60 is preferably transparent glass and may be oriented vertically, horizontally, or at an angle. However, it is within the scope of this invention that the surface 60 be formed from other materials and/or be semi transparent or opaque. Further, surface 60 may include but is not limited to a window, door, a wall, a ceiling, a table top, a car hood, a car roof, an aquarium side, or any other surface which is has a thickness which is thin compared to its length and width.

Figure 3:
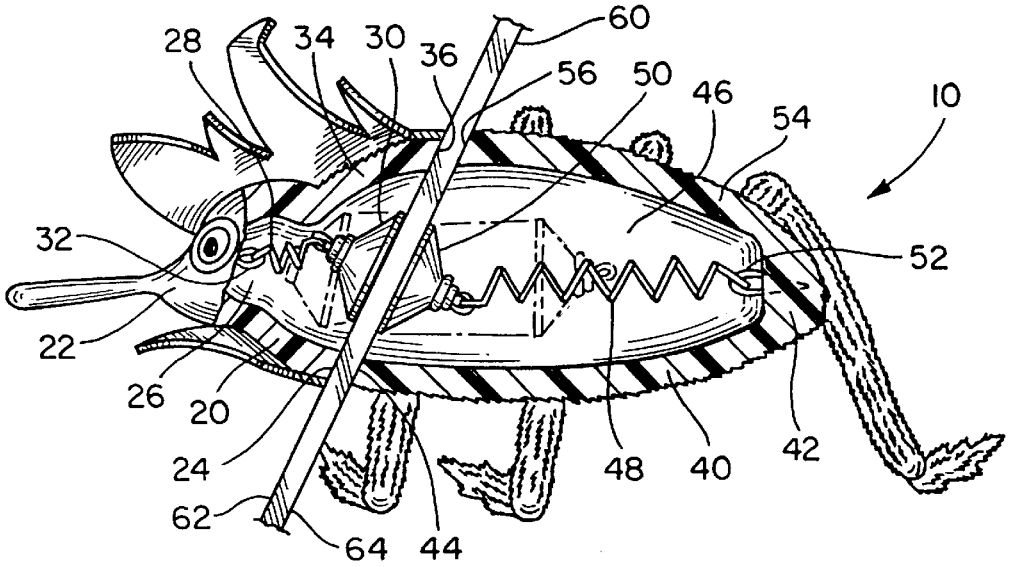
FIG. 3 is a side sectional view of the object in the form of an insect showing how the suction cup is mounted within the interior portion of the hollow object.

FIGS. 1 and 3 illustrate the segmented object 10 in the form of a hollow insect where the first portion 20 includes the head of the insect and the second portion 40 includes the body of the insect. Segmented object 10 has an exterior surface 14 which gives it its appearance, and an interior surface 12. As noted above, segmented object 10 is hollow resulting in an object having a generally thin wall 54 relative to its size. Thus, first 20 and second 40 portions are also hollow. Aside from the appearance of the exterior surface 14, the structure and function of the first 20 and second 40 portions are identical. The structure and function of the first portion 20 corresponds exactly, unless noted, with the structure and function of the second portion 40.

Second portion 40 has a first end 42 and a second end 44. In the illustrative embodiment of FIGS. 1 and 3, the first end 42 is closed and gives the appearance of the tail end of the insect. In this illustrative embodiment, the second end 44 is open and lies abutting surface 60 to which it is mounted.

Wall 54 of the segmented object 10 defines an inner space 46 within the second portion 40. The structure which secures second portion 40 to surface 60 is housed within the inner space 46. In the preferred embodiment, this structure includes spring 48 which is secured to the interior surface 12 of the closed first end 42 by attachment of one end of spring 48 to eye 52 which is embedded in wall 54. The opposite end of spring 48 is attached to suction cup 50. When the second portion 40 is not mounted to surface 60, the resting length of the spring 48 is such that suction cup 50 resides well inside the inner space 46, as shown in phantom in FIG. 3. When the second portion 40 is mounted to surface 60, suction cup 50 adheres to the second side 64 of surface 60, and spring 48 is extended between the suction cup 50 and the closed first end 42. The resulting tension force within spring 48 maintains the second portion 40 in a given position against surface 60. In this way, the structure 48, 50 which secures the second portion 40 to surface 60 is hidden within the inner space 46 when mounted.

First portion 20 has a first end 22 and a second end 24. In the illustrative embodiment of FIGS. 1 and 3, the first end 22 is closed and gives the appearance of the head of the insect. Second end 24 is open and lies abutting surface 60 to which it is mounted.

Wall 54 of the segmented object 10 defines an inner space 26 within the first portion 20. The structure which secures first portion 20 to surface 60 is housed within the inner space 26. In the preferred embodiment, this structure includes spring 28 which is secured to the interior surface 12 of the closed first end 22 by attachment of one end of spring 28 to eye 32 which is embedded in wall 54. The opposite end of spring 28 is attached to suction cup 30. When the first portion 20 is not mounted to surface 60, the resting length of the spring 28 is such that suction cup 30 resides well inside the inner space 26. When the first portion 20 is mounted to surface 60, suction cup 30 adheres to the first side 62 of surface 60, and spring 28 is extended between the suction cup 30 and the closed first end 22. The resulting tension force within spring 28 maintains the first portion 20 in a given position against surface 60. In this way, the structure 28, 30 which secures the first portion 20 to surface 60 is hidden within the inner space 26 when mounted.

It is well within the scope of this invention to provide alternative structures to secure the first 20 and second 40 portions to a surface 60. Structures which may be interchanged with suction cup 30, 50 include, but are not limited to, magnets, adhesive material, or hook and loop fastener. Regardless of the means used to attach the first 20 and second 40 portions of segmented object 10 to surface 60, the respective exterior surfaces 14 of the portions 20, 40 must be in alignment such that segmented object 10 appears to be extending through surface 60 in a continuous, uninterrupted fashion.

In the case of magnets, magnet strength, orientation, and alignment is less critical when surface 60 is metallic. When surface 60 is not metallic, a pair of magnets of high strength should be used, and the pair of magnets must be mounted to the respective ends of springs 28, 48 in an orientation such that the magnets attract each other through surface 60. The magnets must be mounted in alignment on opposing sides of the nonmetallic surface so as to attach the magnets to the surface through their mutual attraction. Note that when suction cups 30, 50 are used, there is no requirement for alignment of suction cups 30, 50 on opposing sides of surface 60.

In the case of hook and loop fastener, one side of the fastening material, for example the hook side, is attached to the free end of spring 28, 48. The complimentary piece of fastening material, in this example the loop side, is formed with self adhesive backing for attachment to surface 60.

Structures which may be interchanged with spring 28, 48 include, but are not limited to, an elastic band. Any alternative structure which can remain hidden within the inner space 26, 46 when mounted and which allows object 10 to be releasably attached to a surface 60 may be substituted for the spring 28, 48 and/or suction cup 30, 50.

Segmented object 10, when not mounted to surface 60, may also be used as a traditional toy or decoration. This is accomplished by joining the first portion 20 to second portion 40 at their respective second ends 24, 44. Each second end 24, 44 of the respective first and second portions has a generally flat end surface 36, 56 (FIG. 1) which extends about the periphery of the segmented object 10 and has a width with corresponds to the thickness of wall 54. End surfaces 36 and 56 are matching since they are formed by sectioning a whole object. Hook and loop fastener 58 may be attached to the end surfaces 36, 56 so that the first 20 and second 40 portions may be releasably attached to each other.

The segmented object 10 is hollow because this minimizes the weight of the object. Minimizing the object's weight allows larger objects to be mounted to surface 60. Use of a hollow object also provides a vacancy in the interior of the object to house the structure which secures the object to the surface so that the structure which secures the object to the surface is hidden from the observer's view. It is within the scope of this invention, however, to use an object which is not hollow but has a solid cross section.

The solid segmented object 800, illustrated in FIG. 9, can accommodate a vacancy or shallow concavity 893, 895 being formed on the sectioned surface 824, 844 of each of the first 820 and second 840 portion, respectively. In this way, the structure 870, 880 which secures the respective portions of the segmented object 800 to the surface 860 can be mounted within the respective vacancy or concavity 893, 895. FIG. 9 shows magnets 870, 880 mounted within the concavity, 893, 895, respectively, in such a way that the surface of magnets 870, 880 lies flush with the sectioned surfaces 824, 844, respectively, and are surrounded and hidden by the outer surface 814 of the object 800 when the object 800 is mounted to surface 860.

Figure 7:
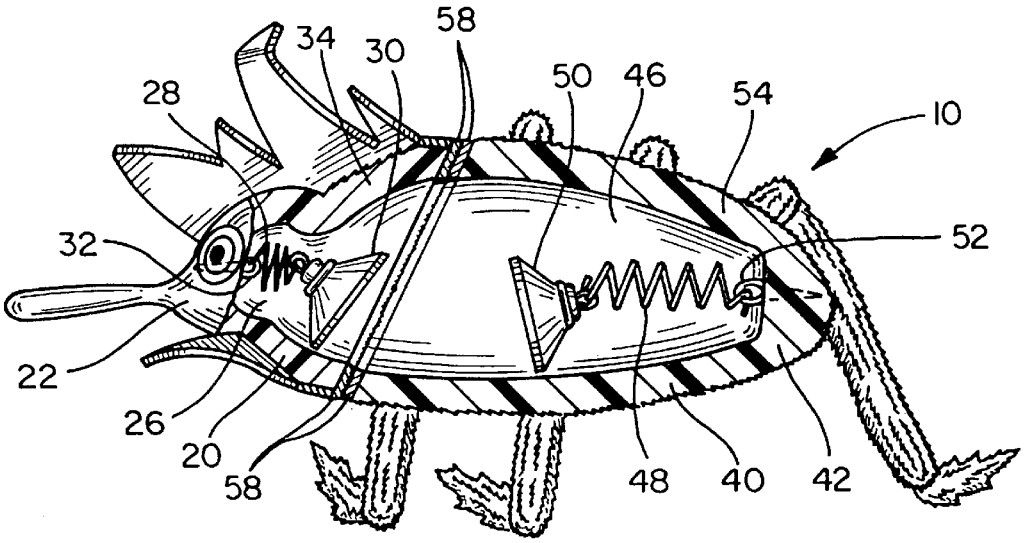
FIG. 7 is a side sectional view of the object in the form of an insect in the instance when it is not attached to a structure, showing the two portions of the object rejoined with hook and loop fastener providing an object which can be used as a toy.

The solid segmented object 800 would also be used as a traditional promotional item, toy, or decoration. This is accomplished by joining the first portion 820 to second portion 840 at their respective sectioned surfaces 824, 844. Each sectioned surface 824, 844 of the respective first and second portions are matching since they are formed by sectioning a whole object. Magnets 870, 880 would hold the first 820 and second 840 portions together in a releasably attached manner. In the instance where another attachment means is substituted for magnets 870, 880, hook and loop fastener may be used on sectioned surfaces 824, 844 in order to attach the first portion 820 to second portion 840 as described for FIG. 7.

It is within the scope of this invention that the respective first ends 22, 42 of either or both of the first 20 and second portions 40 be formed with first ends 22, 42 open rather than closed. In this case, the portion 20, 40 would be generally tube shaped, and the structure which secures portion 20, 40 to surface 60 would be secured to the interior surface 12 adjacent the open first end 22, 42.

Examples of alternative exterior shapes for the first embodiment are shown in FIGS. 2, 4–6, and 9–10. These alternative exterior shapes are provided to illustrate the variety of forms that the segmented object can take, but are not intended to limit the possible exterior shape. Although the exterior shape of these embodiments varies, their interior structure and function is identical to that of the preferred embodiment described above.

Figure 2:
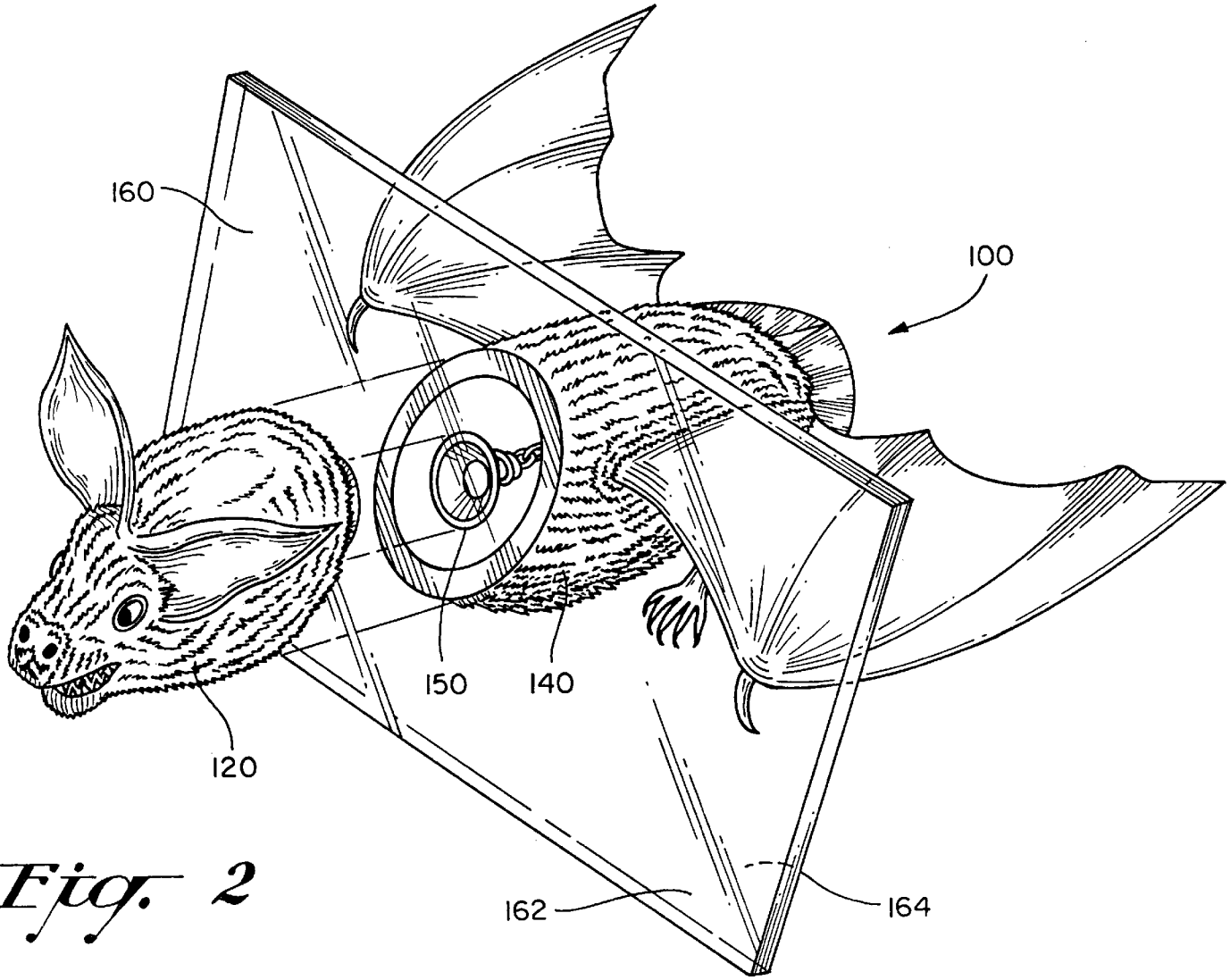
FIG. 2 is a partially exploded perspective view of the object as described for FIG. 1, except that the object is in the form of a bat, illustrating the object's use as a holiday decoration.

A first alternative is shown in FIG. 2 wherein the segmented object 100 has the shape of a bat. In this embodiment, bat 100 is mounted to surface 160 and has a first portion or head 120 mounted on the first side 162 of surface 160 and has a second portion or body with wings 140 mounted on the second side 164 of surface 160. Suction cup 150 is shown attaching the second portion 140 to the surface 160.

Figure 4:
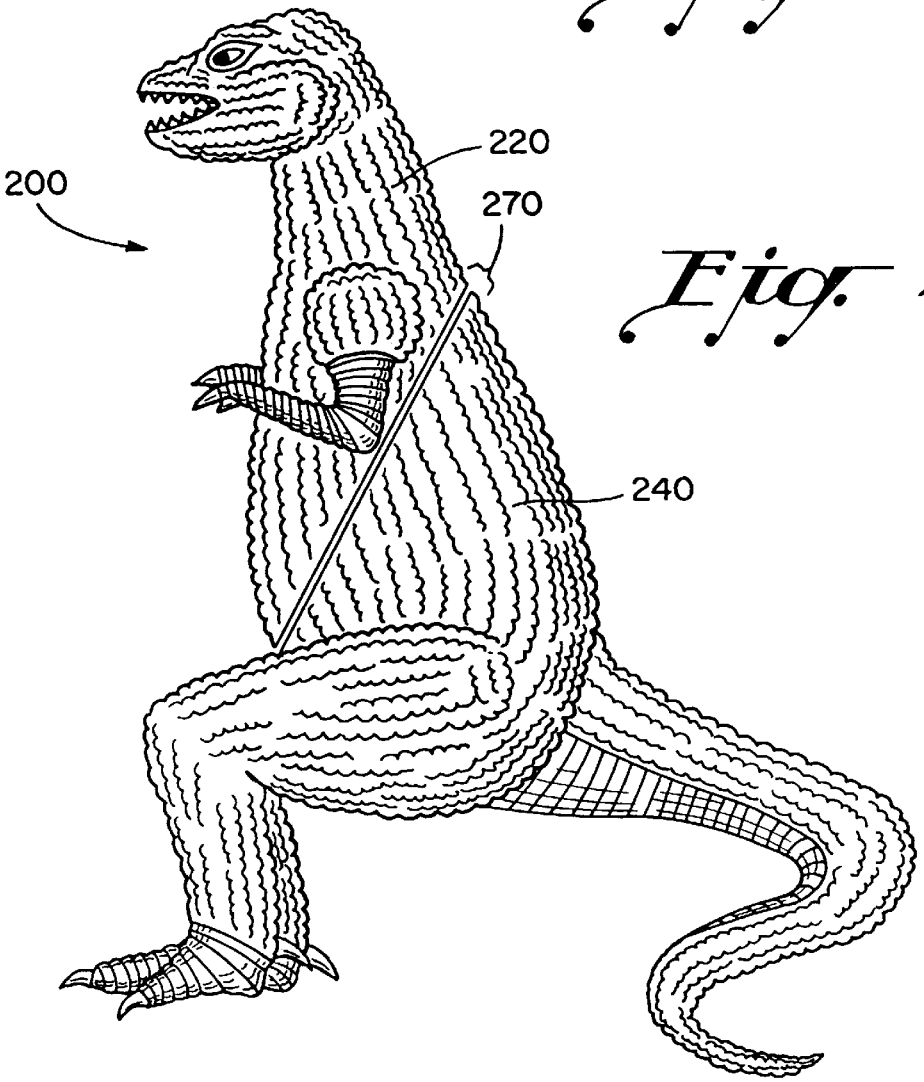
FIG. 4 is a side view of the object in the form of a dinosaur showing one of many possible locations and orientations of the split in the object.

A second alternative is shown in FIG. 4 wherein the segmented object 200 has the shape of a dinosaur. One possible location and orientation of the section is shown at 270, forming a first portion 220 and a second portion 240.

Figure 5:
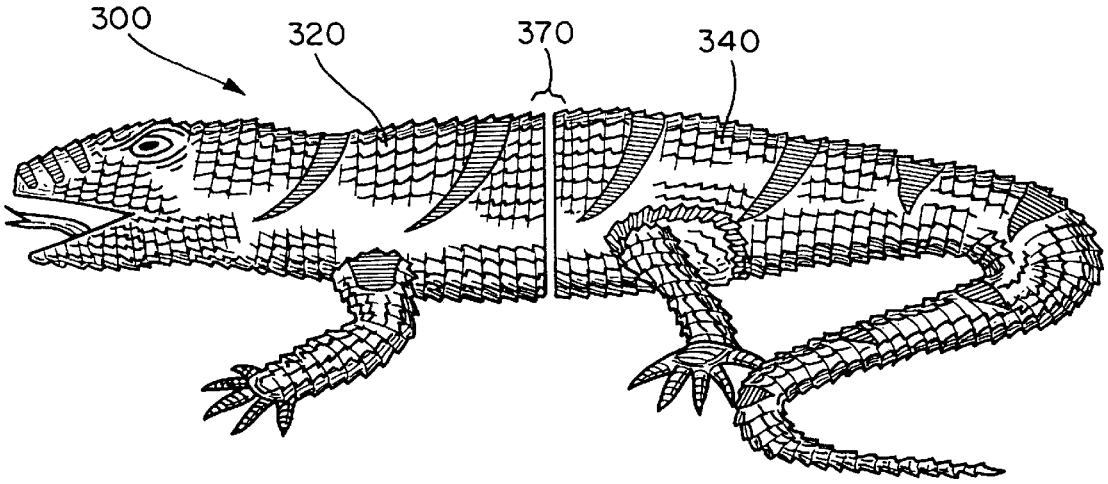
FIG. 5 is a side view of the object in the form of a lizard showing one of many possible locations and orientations of the split in the object.

A third alternative is shown in FIG. 5 wherein the segmented object 300 has the shape of a reptile. One possible location and orientation of the section is shown at 370, forming a first portion 320 and a second portion 340.

Figure 6:
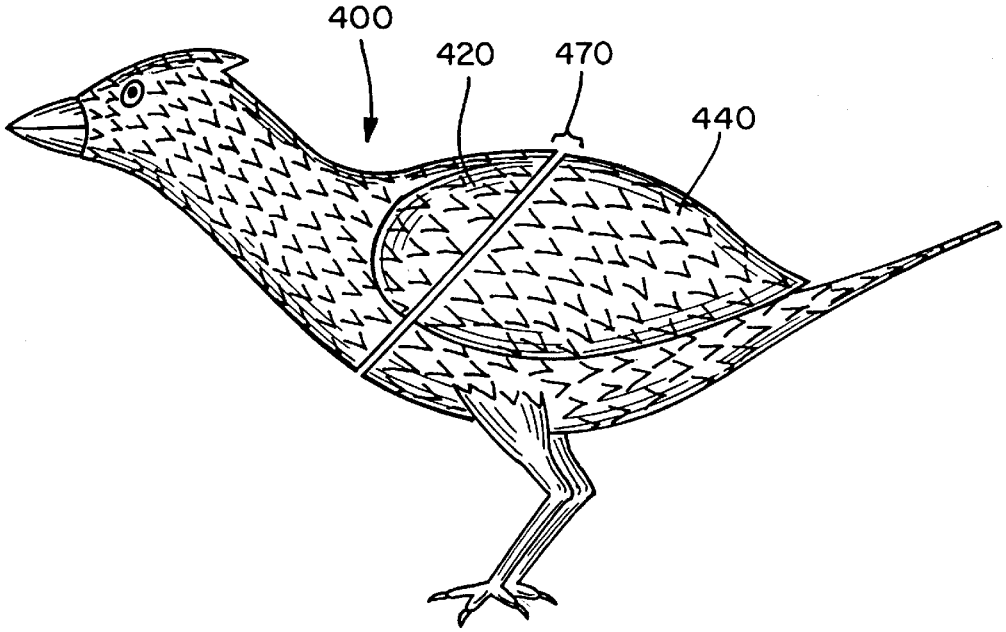
FIG. 6 is a side view of the object in the form of a bird showing one of many possible locations and orientations of the split in the object.

A fourth alternative is shown in FIG. 6 wherein the segmented object 400 has the shape of a bird. One possible location and orientation of the section is shown at 470, forming a first portion 420 and a second portion 440.

Figure 12:
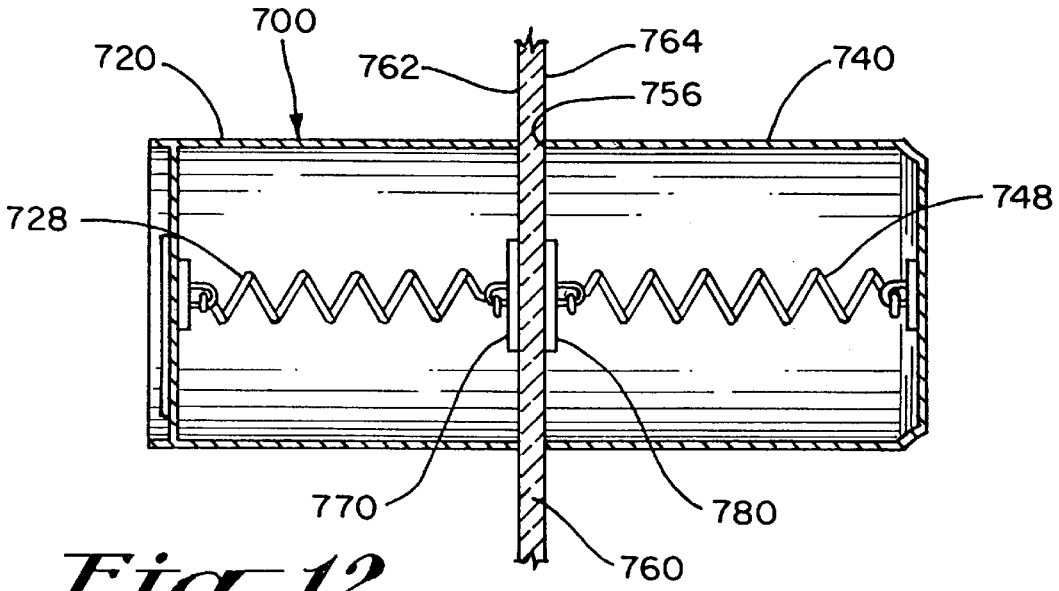
FIG. 12 is a side sectional view of a beverage container attached to a pane of glass using a pair of magnets, the magnets being positioned on opposing sides of the pane and oriented such that they attract each other through the pane.

A fifth alternative is shown in FIGS. 11 and 12 wherein the segmented object 700 has the shape of a beverage container. In this embodiment, beverage container 700 is mounted to surface 760 and has a first portion or upper half of can 720 mounted on the first side 762 of surface 760 and has a second portion or lower half of can 740 mounted on the second side 764 of surface 760. Magnet 780 is shown attaching the second portion 740 to the surface 760.

Figure 10:
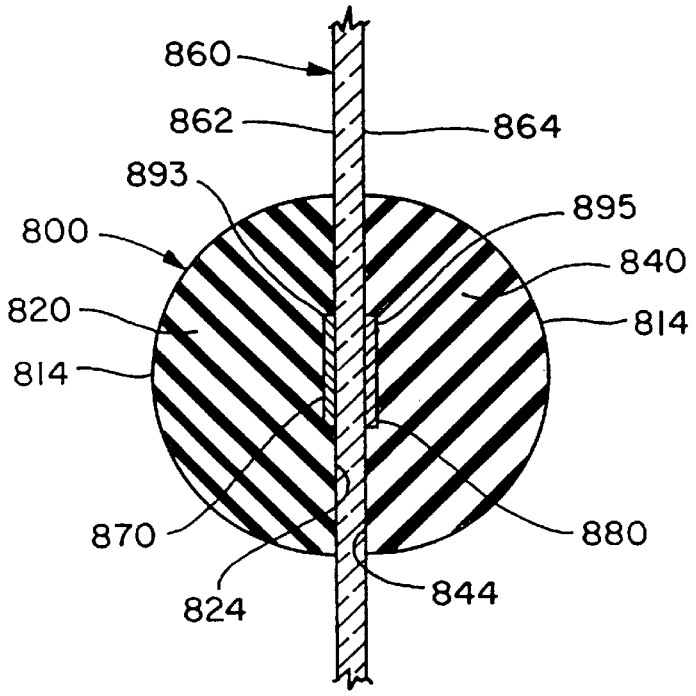
FIG. 10 is a side sectional view of the solid soccer ball of FIG. 9 attached to a pane of glass using a pair of magnets, the magnets being positioned on opposing sides of the pane and oriented such that they attract each other through the pane.

A sixth alternative is shown in FIGS. 9 and 10 wherein the segmented object 800 has the shape of a soccer ball. In this embodiment, soccer ball 800 is mounted to surface 860 and has a first portion 820 mounted on the first side 862 of surface 860 and has a second portion 840 mounted on the second side 864 of surface 860. Magnet 880 is shown attaching the second portion 840 to the surface 860.

Segmented object 10, 100, 200, 300, 400, 700, 800 is preferably formed from a flexible plastic. The plastic should be paintable to provide a toy or decoration which is colorful and attractive. Alternatively, the plastic may be covered with fabric or other materials which give the exterior surface 14 the desired appearance and texture.

Segmented object 10, 100, 200, 300, 400, 700, 800 is preferably sized in the same scale as children's toys. That is, it may have an overall length in the range of two inches to two feet. However, extra-large scale segmented objects may be provided having an overall length in the range of 10 to 20 feet for use as commercial advertising or sales promotional figures. Larger segmented objects would require additional and/or larger suction cups 30, 50.

Figure 8:
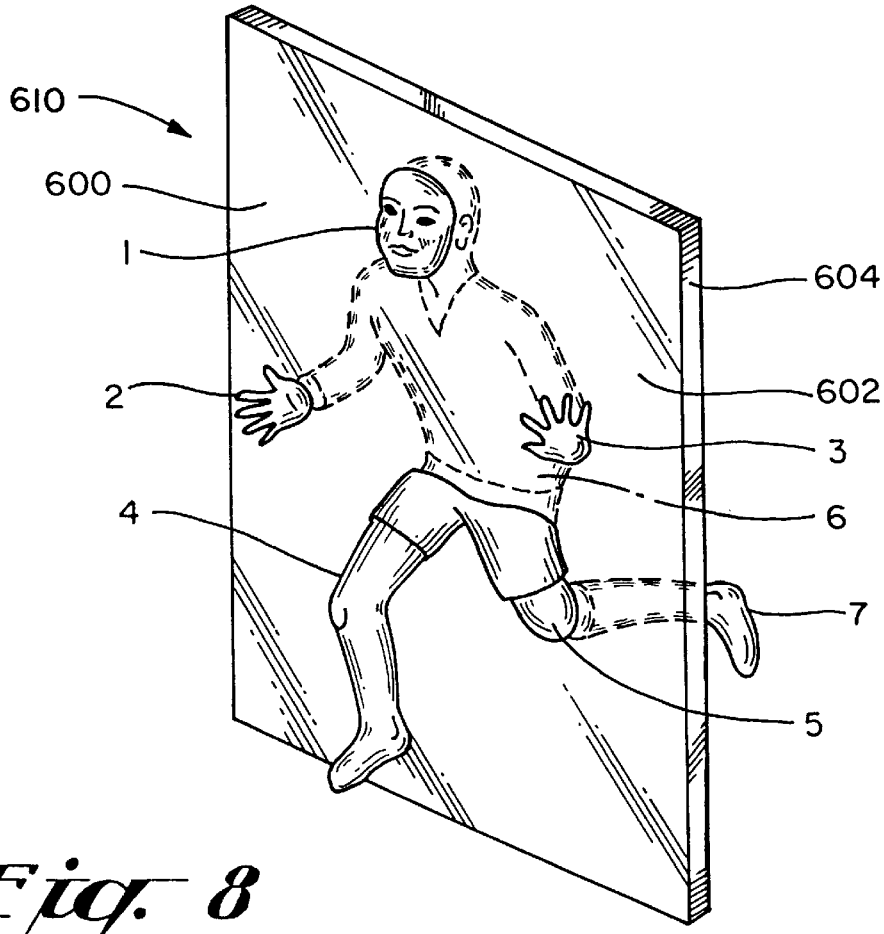
FIG. 8 is a perspective view of the second embodiment of the invention illustrating an object in the form of a human being having seven segments.

The segmented object 10 has been described herein as segmented into two portions. It is well within the scope of this invention to provide an object which has more than two portions. A plurality of portions works well for objects which are elongate, curved, or complex. For example, a second embodiment of the object having the exterior form of a human being may be segmented to give the impression of a person falling through a window by sectioning the body through a plane which separates the front half of the body and the back half of the body. As shown in FIG. 8, plane 600 represents a surface in the form of a window. Plane 600 has a first side 602 and a second side 604. The segmented human body 610 has several portions on the first side 602 and several portions on the second side 604. Appearing to extend through plane 600 to the first side 602 are the face 1, right hand 2, left hand 3, right knee and foot 4, and left knee 5, resulting in five portions. Remaining on the second side 604 are the back of the head, body and arms 6, and the left lower leg and foot 7, resulting in two portions. Thus, this embodiment provides a total of seven segments in the object 610.

I claim:

1. A figure attached to a structure for use as a commercial advertising or sales promotional item, the structure comprising a generally flat body having a first side, a second side opposed to said first side, and a thickness which is thin compared to the width and length of the first and second sides, the figure having an external shape which depicts an object which is being advertised or promoted, the figure being hollow and being sectioned to form a first portion and a second portion, each of the first and second portions having securement means fixed within the hollow interior, the figure secured to the structure by the securement means such that the first and second portions lie adjacent to each other on the structure, and such that the first portion lies on the first side of the structure and the second portion lies on the second side of the structure such that the figure appears to extend completely through the structure in a continuous fashion, wherein each of said first portion and said second portion has a hollow interior, a first end, and an open second end, the securement means comprising a first elastic member fixed to the interior surface of the first end of said first portion and a second elastic member fixed to the interior surface of the first end of said second portion, the securement means further comprising each of first and second elastic members having a free end which extends toward the open second end of the respective first and second portion, the free end of the elastic member terminating in a selectively releasable securement member.

2. The figure of claim 1 wherein the selectively releasable securement member comprises a suction cup.

3. The figure of claim 1 wherein the selectively releasable securement member of said first portion must be in alignment with the selectively releasable securement member of said second portion for attachment of the figure to the structure to be achieved.

4. The figure of claim 3 wherein the selectively releasable securement member comprises a magnet.

5. The figure of claim 1 wherein the first portion and the second portion of the figure has means for selectively rejoining so to form a unified object when the figure is not secured to the structure.

6. The figure of claim 5 wherein the means for selectively rejoining the first portion and the second portion comprises hook and loop fastener placed on respective mating surfaces of the respective open second ends of each of the first and second portions, where hook and loop fastener is comprised of a first piece and a second piece of releasably interlocking fabric, the first piece of releasably interlocking fabric being mounted to the open second end of the first portion, the second piece of releasably interlocking fabric being mounted to the open second end of the second portion, so that when the first piece and second piece are allowed to interlock with each other when the first portion and second portion are positioned with the respective open second ends abutting each other, the object forms a complete figure having a smooth uninterrupted outer surface.

7. The figure of claim 5 wherein the figure comprises the shape of a beverage container.

8. The figure of claim 5 wherein the figure comprises the shape of a piece of sports equipment.

9. The figure of claim 5 wherein the figure comprises the shape of a creature.

10. An object for use as a sales promotional item, a decoration, or as a toy, the object having an outer wall, the object being split to form a first portion and a second portion, the object being mountable to a generally planar structure such that the first portion and the second portion are mounted in alignment on opposing sides of the planar structure giving the object the appearance of extending through the generally planar structure, each of said first portion and said second portion having a closed first end and an open second end, each of said first portion and said second portion having an elastic member fixed to the surface of the closed first end, the elastic member having a free end which extends toward said open second end, the free end of the elastic member terminating in a first securement means.

11. The object of claim 10 wherein the first securement means is comprised of a suction cup, the suction cup allowing each of said first and second portions of the object to be releasably mounted adjacent to each other on opposing sides of a generally planar structure such that the object appears to be extending completely through the structure.

12. The object of claim 10 wherein the first securement means is comprised of hook and loop fastener, the hook and loop fastener allowing each of said first and second portions of the object to be releasably mounted adjacent to each other on opposing sides of a structure such that the object appears to be extending completely through the structure, wherein hook and loop fastener is comprised of a first piece and a second piece of releasably interlocking fabric, the first piece of releasably interlocking fabric being mounted to the free end of the elastic member, the second piece of releasably interlocking fabric being mounted to said generally planar structure, so that when the first piece and second piece are allowed to interlock with each other each of said first portion and said second portion are secured to the structure.

13. The object of claim 10 wherein the first securement means is comprised of a pair of magnets, the pair of magnets allowing each of said first and second portions of the object to be releasably mounted adjacent to each other on opposing sides of a structure such that the object appears to be extending completely through the structure, one of said pair of magnets being mounted to the free end of the elastic member in each respective said first portion and said second portion, each of said pair of magnets being oriented such that the magnets attract each other when in alignment with each other on opposing sides of the structure.

14. The object of claim 10 wherein the open second end of each of said first portion and said second portion comprises a generally flat end surface which extends about the periphery of the object and which has a width which corresponds to the thickness of the outer wall, the shape of the flat end surface the first portion being identical to the shape of the flat end surface of the second portion such that when the first portion and second portion are positioned with the respective open second ends abutting each other, the object forms a complete creature having a smooth uninterrupted outer surface.

15. The object of claim 14 wherein the end surface of the open second end of each of said first portion and said second portion comprises hook and loop fastener to allow releaseble attachment of the first portion to the second portion, where hook and loop fastener is comprised of a first piece and a second piece of releasably interlocking fabric, the first piece of releasably interlocking fabric being mounted to the end surface of the open second end of the first portion, the second piece of releasably interlocking fabric being mounted to the end surface of the open second end of the second portion, so that when the first piece and second piece are allowed to interlock with each other when the first portion and second portion are positioned with the respective open second ends abutting each other, the object forms a complete figure having a smooth uninterrupted outer surface.

16. An object for use as a commercial advertising item, sales promotional item, decorative figure, or toy, the object having any outer shape, the object being sectioned to form at least three segments which are releasably attachable to either side of a generally planar surface so as to form a complete figure when said at least three segments are appropriately arranged about said planar surface.

17. The object of claim 16 wherein the object is hollow and wherein each of said plural segments comprises a releasable securement means attached to an inner surface for securing each respective plural segment to said planar surface.

18. The object of claim 17 wherein each of said plural segments has a first end which is formed by the sectioning of the object and a second end which is opposed to said first end, and wherein said releasable securement means comprises an elongate elastic member having a fixed end which is attached to said inner surface at a said second end of the segment, said elastic member having a free end opposed to said fixed end, and wherein said releasable securement means further comprises an attachment member extending from said free end of the elastic member.

19. The object of claim 18 wherein the attachment member comprises a magnet, the magnet being mounted to the free end of the elastic member in each of said plural segments, the magnet being being oriented such that when one of said plural segments is placed adjacent a structure with a complimentary one of said plural segments on the opposite side of a structure such that the respective magnets for each segment are in alignment, the object is maintained in a stationary position on the structure.

20. An object for use as a sales promotional item, a decoration, or as a toy, the object being sectioned to form a first portion and a second portion, the object being mountable to a generally planar structure such that the first portion and the second portion are mounted in alignment on opposing sides of the planar structure giving the object the appearance of extending through the generally planar structure, each of said first portion and said second portion having a solid cross section and an outer surface, the outer surface being contoured except at a first end, the first end being a generally flat end surface resulting from the sectioning of the object, wherein the generally flat end surface of each of said first portion and said second portion comprises a shallow concavity, said shallow concavity not extending to any portion of the outer surface, and wherein a first securement means is completely housed within said shallow concavity such that said first securement means substantially completely fills said shallow concavity and such that when the first and second portions of the object are mounted in alignment on opposing sides of the planar structure, said first securement means is hidden by the outer surface of the object.

21. The object of claim 20 wherein the first securement means is comprised of a suction cup, the suction cup allowing each of said first and second portions of the object to be releasably mounted adjacent to each other on opposing sides of a generally planar structure such that the object appears to be extending completely through the generally planar structure.

22. The object of claim 20 wherein the first securement means is comprised of a pair of magnets, the pair of magnets allowing each of said first and second portions of the object to be releasably mounted adjacent to each other on opposing sides of a generally planar structure such that the object appears to be extending completely through the generally planar structure, one of said pair of magnets being mounted within the shallow concavity in each respective said first portion and said second portion, each of said pair of magnets being oriented such that the magnets attract each other when in alignment with each other on opposing sides of the generally planar structure.

23. The object of claim 20 wherein the said generally flat end surface of each of said first portion and said second portion extends about the periphery of the object between the shallow concavity and the outer surface, the shape of the flat end surface the first portion being identical to the shape of the flat end surface of the second portion such that when the first portion and second portion are positioned with the respective generally flat end surfaces abutting each other, the object is unified and has a continuous outer surface, wherein the said generally flat end surface of each of said first portion and said second portion comprises hook and loop fastener to allow releaseble attachment of the first portion to the second portion, where hook and loop fastener is comprised of a first piece and a second piece of releasably interlocking fabric, the first piece of releasably interlocking fabric being mounted to the flat end surface of the first portion, the second piece of releasably interlocking fabric being mounted to the flat end surface of the second portion, so that when the first piece and second piece are allowed to interlock with each other when the first portion and second portion are positioned with the respective open second ends abutting each other, the object forms a complete creature having a smooth uninterrupted outer surface.

24. An object for use as a decoration or as a toy and having an external form in the shape of a creature, the object being hollow and having an outer wall, the object being split to form a first portion and a second portion, the object being mountable to a generally planar structure such that the first portion and the second portion are mounted in alignment on opposing sides of the planar structure giving the object the appearance of extending through the generally planar structure, each of said first portion and said second portion having a hollow interior, a closed first end and an open second end, each of said first portion and said second portion having an elastic member directly fixed to the interior surface of the closed first end, the elastic member having a free end which extends toward said open second end, the free end of the elastic member terminating in a first securement means.

25. The object of claim 24 wherein the elastic member is comprised of a spring.

26. The object of claim 25 wherein the first securement means is comprised of a suction cup, the suction cup allowing each of said first and second portions of the object to be releasably mounted adjacent to each other on opposing sides of a generally planar structure such that the object appears to be extending completely through the structure.

27. The object of claim 25 wherein the first securement means is comprised of hook and loop fastener, where hook and loop fastener is comprised of a first piece and a second piece of releasably interlocking fabric, the first piece of releasably interlocking fabric being mounted to the free end of the elastic member, the second piece of releasably interlocking fabric being mounted to the structure, so that when the first piece and second piece are allowed to interlock with each other, each of said first and second portions of the object may be releasably mounted adjacent to each other on opposing sides of a structure such that the object appears to be extending completely through the structure.

28. The object of claim 26 wherein the open second end of each of said first portion and said second portion comprises a generally flat end surface which extends about the periphery of the object and which has a width which corresponds to the thickness of the outer wall, the shape of the flat end surface the first portion being identical to the shape of the flat end surface of the second portion such that when the first portion and second portion are positioned with the respective open second ends abutting each other, the object forms a complete creature having a smooth uninterrupted outer surface.

29. The object of claim 28 wherein the end surface of the open second end of each of said first portion and said second portion comprises a second securement means.

30. The object of claim 29 wherein the second securement means comprises hook and loop fastener where hook and loop fastener is comprised of a first piece and a second piece of releasably interlocking fabric, the first piece of releasably interlocking fabric being mounted to the flat end surface of the first portion, the second piece of releasably interlocking fabric being mounted to the flat end surface of the second portion, so that when the first piece and second piece are allowed to interlock with each other when the first portion and second portion are positioned with the respective open second ends abutting each other, the object forms a complete creature having a smooth uninterrupted outer surface.

31. A figure for decoration of a structure, the structure comprising a generally flat body having a first side, a second side opposed to said first side, and a thickness which is thin compared to the width and length of the first and second sides, the figure being hollow and being sectioned to form a first portion and a second portion, each of the first and second portions having securement means fixed within the hollow interior, the figure secured to the structure by the securement means such that the first and second portions lie adjacent to each other on the structure, and such that the first portion lies on the first side of the structure and the second portion lies on the second side of the structure such that the figure appears to extend completely through the structure, wherein each of said first portion and said second portion has a hollow interior, a first end, and an open second end, the securement means comprising a first elastic member fixed to the interior surface of the first end of said first portion and a second elastic member fixed to the interior surface of the first end of said second portion, the securement means further comprising each of first and second elastic members having a free end which extends toward the open second end of the respective first and second portion, the free end of the elastic member terminating in a selectively releasable securement member.

32. The figure of claim 31 wherein the selectively releasable securement member comprises a suction cup.

33. The figure of claim 31 wherein the selectively releasable securement member comprises hook and loop fastener where hook and loop fastener is comprised of a first piece and a second piece of releasably interlocking fabric, the first piece of releasably interlocking fabric being mounted to the free end of the elastic member, the second piece of releasably interlocking fabric being mounted to the structure, so that when the first piece and second piece are allowed to interlock with each other each of said first portion and said second portion are secured to the structure.

34. The figure of claim 32 wherein the first portion and the second portion of the figure has means for selectively rejoining so to form a unified object when the figure is not secured to the structure.

35. The figure of claim 34 wherein the means for selectively rejoining the first portion and the second portion comprises hook and loop fastener where hook and loop fastener is comprised of a first piece and a second piece of releasably interlocking fabric, the first piece of releasably interlocking fabric being mounted to the open second end of the first portion, the second piece of releasably interlocking fabric being mounted to the open second end of the second portion, so that when the first piece and second piece are allowed to interlock with each other when the first portion and second portion are positioned with the respective open second ends abutting each other, the object forms a complete creature having a smooth uninterrupted outer surface.

36. The figure of claim 35 wherein the figure comprises the shape of a dinosaur.

37. The figure of claim 35 wherein the figure comprises the shape of an insect.

38. The figure of claim 35 wherein the figure comprises the shape of a human being.

39. The figure of claim 35 wherein the figure comprises the shape of an animal.

40. An object for use as a decorative figure or a toy, the object having an outer shape in the form of a creature, the object being sectioned to form at least three segments which are releasably attachable to either side of a generally planar surface so as to form a complete figure when said plural segments are appropriately arranged about said planar surface.

41. The object of claim 40 wherein the object is hollow and wherein each of said plural segments comprises a releasable securement means attached to an inner surface for securing each respective plural segment to said planar surface.

42. The object of claim 41 wherein each of said plural segments has a first end which is formed by the sectioning of the object and a second end which is opposed to said first end, and wherein said releasable securement means comprises an elongate elastic member having a fixed end which is attached to said inner surface at a said second end of the segment, said elastic member having a free end opposed to said fixed end, and wherein said releasable securement means further comprises an attachment member extending from said free end of the elastic member.

43. The object of claim 42 wherein the attachment member comprises a suction cup.

44. The object of claim 42 wherein the attachment member comprises hook and loop fastener where hook and loop fastener is comprised of a first piece and a second piece of releasably interlocking fabric, the first piece of releasably interlocking fabric being mounted to the free end of the elastic member, the second piece of releasably interlocking fabric being mounted to said generally planar surface, so that when the first piece and second piece are allowed to interlock with each other each of said plural segments may be releasably mounted to said generally planar surface so as to form a complete figure when said segments are appropriately arranged about said generally planar surface.

* * * * *